US012186628B2

(12) United States Patent
Neuhaus

(10) Patent No.: US 12,186,628 B2
(45) Date of Patent: Jan. 7, 2025

(54) MOTORIZED PILATES REFORMER

(71) Applicant: OxeFit, Inc., Pensacola, FL (US)

(72) Inventor: Peter Neuhaus, Pensacola Beach, FL (US)

(73) Assignee: OxeFit, Inc., Plano, TX (US)

( * ) Notice: Subject to any disclaimer, the term of this patent is extended or adjusted under 35 U.S.C. 154(b) by 301 days.

(21) Appl. No.: 17/495,575

(22) Filed: Oct. 6, 2021

(65) Prior Publication Data

US 2023/0105920 A1 Apr. 6, 2023

(51) Int. Cl.
*A63B 24/00* (2006.01)
*A63B 21/00* (2006.01)
*A63B 21/005* (2006.01)

(52) U.S. Cl.
CPC .... *A63B 24/0087* (2013.01); *A63B 21/00069* (2013.01); *A63B 21/0058* (2013.01)

(58) Field of Classification Search
CPC ..... A63B 24/0087; A63B 21/00069; A63B 21/0058
See application file for complete search history.

(56) References Cited

U.S. PATENT DOCUMENTS 8,764,609 B1 * 7/2014 Elahmadie ..... A63B 23/0211 482/57
2012/0190503 A1 * 7/2012 Shavit ..... A63B 24/0062 482/5
2013/0017935 A1 1/2013 Endelman et al.
2013/0157819 A1 * 6/2013 Uygan ..... A63B 21/4043 482/123
2014/0121076 A1 5/2014 Lagree
2016/0166870 A1 6/2016 Lagree
2017/0209728 A1 * 7/2017 Lagree ..... A63B 21/055
2018/0015319 A1 1/2018 Lagree et al.
2019/0046830 A1 * 2/2019 Chiavegato ..... A63B 24/0062
2019/0321675 A1 * 10/2019 Wilt ..... A63B 23/0405
2020/0188720 A1 * 6/2020 Villency ..... A63B 21/4031
2023/0017705 A1 * 1/2023 Lagree ..... A63B 21/00069

FOREIGN PATENT DOCUMENTS

RU 200020 U1 * 10/2020
WO WO-9111218 A * 8/1991 ..... A63B 23/00
WO WO-2019100117 A1 * 5/2019 ..... A63B 21/00069

OTHER PUBLICATIONS

International Search Report and Written Opinion in PCT/US2022/045493 DTD Jan. 24, 2023.

* cited by examiner

*Primary Examiner* — Sundhara M Ganesan
*Assistant Examiner* — Jacqueline N L Loberiza
(74) *Attorney, Agent, or Firm* — Foley & Lardner LLP

(57) ABSTRACT

A reformer includes a base having a longitudinal direction, a carriage coupled to the base and moveable relative to the base in the longitudinal direction, and an actuator coupled to the carriage and the base such that the actuator is arranged to exert a force between the carriage and the base. The force moves the carriage relative to the base in the longitudinal direction or resists movement of the carriage relative to the base in the longitudinal direction.

20 Claims, 6 Drawing Sheets

MOTORIZED PILATES REFORMER

BACKGROUND

The present disclosure relates generally to Pilates equipment, in particular to Pilates reformers. A reformer is a unit of exercise equipment used primarily for Pilates workouts. Conventional reformers use mechanical springs to create forces which resist or assist performance of various exercises. Mechanical springs are only capable of providing forces that increase linearly with distance (i.e., distance multiplied by a spring constant according to Hooke's law). The mechanical springs must be physically disconnected, reconnected, added in different combinations, etc. to select different discrete spring constants, which is a cumbersome process, can be confusing even for experienced users, and also only selection of a limited number of discrete spring combinations.

SUMMARY

One implementation of the present disclosure is a reformer. The reformer includes a base having a longitudinal direction, a carriage coupled to the base and moveable relative to the base in the longitudinal direction, and an actuator coupled to the carriage and the base such that the actuator is arranged to exert a force between the carriage and the base. The force moves the carriage relative to the base in the longitudinal direction or resists movement of the carriage relative to the base in the longitudinal direction.

In some embodiments, the reformer also includes a controller communicable with the actuator and the controller is configured to control the actuator to vary the force as a function of a position of the carriage relative to the base. The function may include multiplying a distance between the position of the carriage and a fixed reference point by a constant such that the force simulates a spring force. The reformer may include a reformer and the constant may be user-selectable via a user interface.

In some embodiments, the reformer also includes a controller communicable with the actuator and the controller is configured to control the actuator to vary the force as a function of a velocity of the carriage relative to the base. The function may provide changes in the force configured to dampen the velocity of the carriage relative to the base.

In some embodiments, the reformer also includes a controller communicable with the actuator and the controller is configured to control the actuator to move the carriage along an exercise trajectory defined by desired carriage positions for a plurality of time steps.

In some embodiments, the actuator includes a spool, an electric motor coupled to the spool, and a cable extending from the spool to the carriage and arranged to wind around the spool. The electric motor is operable to exert a torque on the spool to wind the cable around the spool and resist unwinding of the cable from the spool such that the force on the carriage results from the torque on the spool by the electric motor. In some embodiments, the actuator includes a linear electrical actuator. In some embodiments, the actuator includes a threaded shaft and an electric motor coupled to the threaded shaft and operable to rotate the threaded shaft. The carriage may be mounted on the threaded shaft such that rotation of the threaded shaft causes translation of the carriage along the longitudinal direction of the base.

In some embodiments, the carriage includes a padded platform, a shoulder rest, and a headrest. The reformer may also include a post extending from the base, a pulley mounted on the base, a cable coupled to the carriage, and a handle. The cable may extend from the carriage and around the pulley to the handle. The actuator can pull the carriage toward a first end of the base along the longitudinal direction, while pulling on the handle pulls the carriage toward a second end of the base opposite the first end along the longitudinal direction. In some embodiments, the reformer also includes a footrest mounted on the base.

In some embodiments, the reformer also includes a controller configured to perform a comparison of a position of the carriage to a predefined desired position for a selected exercise and cause feedback to be provided to a user of the reformer based on the comparison.

Another implementation of the present disclosure is a method of providing a Pilates exercise. The method includes obtaining an exercise setting, determining a position of a carriage relative to a base of a reformer, calculating a target force as a function of the position of the carriage and the exercise setting, and exerting the target force on the carriage by operating an actuator coupled to the carriage in accordance with the target force.

In some embodiments, the exercise setting is associated with a spring constant and wherein the function uses the spring constant. Calculating the target force may include determining a distance between the position of the carriage and a fixed reference point and multiplying the distance by the spring constant.

In some embodiments, obtaining the exercise setting includes receiving the exercise setting from a user via a user interface. In some embodiments, obtaining the exercise setting includes determining the exercise setting based on a Pilates workout regimen.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Referring generally to the figures, a motorized reformer and processes for operating the motorized reformer to provide Pilates exercises are shown, according to some embodiments. The motorized reformer and features thereof addresses challenges with conventional reformers by controlling one or more actuators to provide resistive and assistive forces on the carriage of a reformer. By controlling the one or more actuators, the motorized reformer can provide a substantially continuous range of settings and forces, providing an advantage over limited options of discrete springs in conventional reformers. Forces generated by the motorized reformer can be easily customized and controlled via a user interface or programmed Pilates exercise regime, thereby eliminating the cumbersome process of adjusting springs used in conventional reformers. Additionally, the motorized reformer can operate to provide spring-like forces (i.e., increasing linearly with distance) and can provide a wide variety of other dynamic or static forces to the carriage throughout an exercise or workout. These and other features of advantages of the present disclosure are described in detail below.

Figure 1:
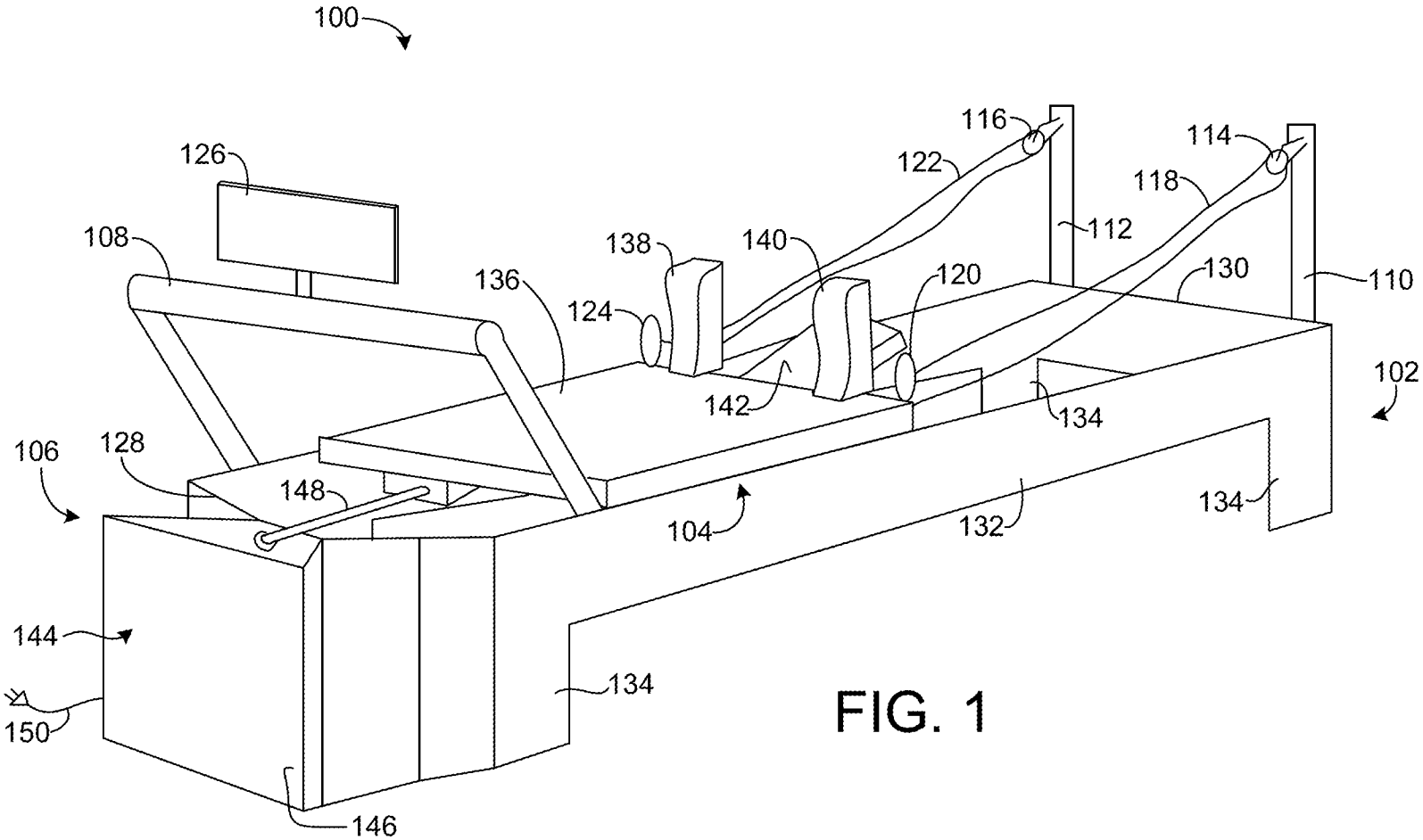
FIG. 1 is a perspective view of a motorized reformer, according to some embodiments.

Referring now to FIG. 1, a perspective view of a motorized reformer 100 is shown, according to some embodiments. The motorized reformer 100 includes a base 102, a carriage 104 coupled to the base 102 and moveable along the base 102, and an actuator 106 coupled to the carriage 104. The motorized reformer 100 is also shown as including a footrest 108 coupled to the base 102, a first post 110 extending from the base 102, a second post 112 extending from the base 102, a first pulley 114 on the first post 110, a second pulley 116 on the second post 112, a first cable 118 extending from the carriage 104 and around the first pulley 114 to a first handle 120, and a second cable 122 extending from the carriage 104 and around the second pulley 116 to a second handle 124. The motorized reformer 100 is also shown as including a user interface device, shown as display console 126.

The base 102 provides a stable foundation for the reformer 100 and defines a longitudinal direction of the reformer 100 extending from a first end 128 of the base 102 to a second end 130 of the base 102. The base 102 is shown as including a substantially rectangular frame 132 supported by multiple legs 134. The multiple legs 134 hold the frame 132 above a ground or floor surface supporting the reformer 100.

The carriage 104 is moveably coupled to the base 102. As shown in FIG. 1, the carriage 104 is positioned on or in the frame 132. The carriage 104 is configured to move along the frame 132 such that the carriage 104 can move along the longitudinal direction of the base 102, including toward the first end 128 of the base 102 and toward the second end 130 of the base 102. For example, the frame 132 and the carriage 104 may include interface tracks, bearings, rollers, guide posts, lubrication, etc. that couple the carriage 104 to the frame 132 while allowing smooth, repeatable movement of the carriage 104 in the longitudinal direction of the base 102. The frame 132 may engage the carriage 104 to prevent movement of the carriage 104 relative to the base 102 in other directions (e.g., in a lateral direction, in a rotational direction, in a vertical direction).

The carriage 104 is shown as including a platform (shown as padded platform 136), a first shoulder rest 138 positioned at an edge of the padded platform 136 and extending orthogonally from the padded platform 136, a second shoulder rest 140 spaced apart from the first shoulder rest 138 and extending orthogonally from the padded platform 136, and a headrest 142 extending from the padded platform 136 between the first shoulder rest 138 and the second shoulder rest 140. The first shoulder rest 138, the second shoulder rest 140, and/or the headrest 142 may be selectively attachable and removable from the padded platform 136 in various embodiments.

When attached to the padded platform 136 as shown in FIG. 1, the first shoulder rest 138 and the second shoulder rest 140 allow a user lying on the platform 136 to contact the user's shoulders with the first shoulder rest 138 and the second shoulder rest 140 such that the user can exert a force on the first shoulder rest 138 and the second shoulder rest 140. For example, a user may lie on the platform 136 with the user's feet on the footrest 108 and the user's shoulders against the first shoulder rest 138 and the second shoulder rest 140, and then exert a force (i.e., with muscular contractions) between the footrest 108 and the first shoulder rest 138 and the second shoulder rest 140 which can cause the carriage 104 to slide away from the footrest 108 and toward the second end 130 of the base 102 in the longitudinal direction of the base 102. The headrest 142 can support the user's head during such a use of the reformer 100. During such exercises motion of the carriage 104 is resisted and/or assisted by operation of the actuator 106 as described in detail below. For example, the actuator 106 may resist movement of the carriage 104 toward the second end 130 of the base 102 (i.e., while the user exerts a force toward the second end 130 on the first shoulder rest 138 and the second shoulder rest 140) while assisting movement of the carriage 104 back toward the first end 128 in a subsequent phase of an exercise.

Detaching the first shoulder rest 138 and the second shoulder rest 140 from the padded platform 136 can allow for performance of a variety of other exercises without obstruction by the first shoulder rest 138 and the second shoulder rest 140. For example, in some such exercises a user lies on the carriage 104 and holds the first handle 120 and the second handle 124. When the user moves the first handle 120 and the second handle 124 toward the first end 128 of the base 102, the first cable 118 and the second cable 122 pull the carriage 104 toward the second end 130 of the base 102 (due to routing of the first cable 118 around the first pulley 114 and routing of the second cable 122 around the second pulley 116). Such movement of the carriage 104 can also be resisted and/or assisted by operation of the actuator 106 as described in detail below. For example, the actuator 106 may resist movement of the carriage 104 toward the second end 130 of the base 102 (i.e., while the user moves the first handle 120 and the second handle 124 toward the first end 128 of the base 102) while assisting movement of the carriage 104 back toward the first end 128 in a subsequent phase of an exercise.

The reformer 100 thereby provides various ways in which a user can cause movement of the carriage 104 relative to the base 102. For example, Pilates workout regimens (courses, classes, exercise plans, etc.) may include a wide variety of exercise in which users contort their bodies in various ways that create, benefit from, or otherwise involve movement of the carriage 104 in the longitudinal direction of the base 102.

The actuator 106 is coupled to the carriage 104 and exerts a force on the carriage 104 such that the force can cause movement of the carriage 104 relative to the base 102 in the longitudinal direction of the base 102. In the embodiments herein, the force on the carriage 104 from the actuator 106 points towards the first end 128 or the actuator 106 may be configured to exert forces pointing both toward the first end 128 and pointing toward the second end 130.

As shown in FIG. 1, the actuator 106 includes an electric motor 144 in a housing 146 and a force transfer member 148 extending from the carriage 104 to the electric motor 144. The force transfer member 148 may be a cable, rope, cord, chain, shaft, threaded shaft, rod, post, piston, block, or other connector through which force or movement generated by the electric motor 144 is mechanically transferred from the electric motor 144 to the carriage 104 (and vice versa in some scenarios). The actuator 106 is also shown as including a power cord 150 extending from the electric motor 144 and configured to connect to an electric outlet to receive electricity for powering the electric motor 144. The housing 146 of the actuator 106 is shown as coupled to the base 102. In other embodiments, the housing 146 is separated from the base 102.

In the example shown, the actuator 106 is positioned at the first end 128 of the base 102 and under the footrest 108, with the force transfer member 148 extending from at least the first end of the base 102 to the carriage 104. The force transfer member 148 is aligned with the longitudinal direction of the base 102. The actuator 106 is thereby arranged to exert a force on the carriage 104, e.g., a force between the base 102 and the carriage 104, aligned with the available direction of movement of the carriage 104 relative to the base 102. The force provided by the actuator 106 on the carriage 104 can thereby resist movement of the carriage 104 in the longitudinal direction of the base 102 and cause or assist movement of the carriage 104 in the longitudinal direction of the base 102 in various scenarios/uses of the carriage 104.

For example, in some scenarios the actuator 106 operates to provide a force on the carriage 104 which points towards the first end 128 of the base 102. A user of the reformer may perform exercises in which the user pushes, pulls, etc. the carriage 104 toward the second end 130. In such scenarios, the actuator 106 operates to resist movement of the carriage toward the second end 130. In such scenarios, if a user-exerted force exceeds the force provided by the actuator 106, the carriage 104 will move toward the second end 130; if the user-exerted force matches the force provided by the actuator 106, the carriage 104 will remain stationary (as may be desirable in certain exercises, e.g., exercises involving static holds); and if the user-exerted force is less than the force provided by the actuator 106, the carriage 104 will move toward the first end 128. When the user-exerted force is less than the force provided by the actuator 106, the actuator 106 can be considered as causing or assisting movement of the carriage 104 toward the first end 128.

In some scenarios, the actuator 106 is also operable to provide a force on the carriage 104 which points toward the second end 130 of the base 102. Such scenarios are described with reference to FIGS. 3-4 below.

The reformer 100 is also shown as including a display console 126 coupled to the base. The display console 126 is shown as being mounted on the footrest 108. In other embodiments, the display console 126 may be mounted on a stanchion (post, arm, etc.) extending from the base 102 separately from the footrest 108. In yet other embodiments, the display console 126 may be on a stand or cart decoupled from the base 102.

The display console 126 is configured to display various graphics, data, instructions, etc. relating to operation of the reformer, for example by including a digital screen (e.g., LCD screen), speakers, etc. The display console 126 is also configured to receive user input, e.g., for example by being configured as a touchscreen, by including buttons, keys, knobs, etc., by including a microphone to receive voice commands, and/or by including a camera to receive touchless gesture commands. The display console 126 can include memory and processing components configured to received data relating to operation and use of the reformer 100 and to generate a graphical user interface based on such data. For example, the display console 126 may display exercise settings for selection by a user (e.g., type or direction of force, type of exercise, spring type or spring constant, resistance level, difficulty level, etc.) and receive user selection of exercise settings. As another example, the display console 126 may display pacing or timing for exercises, for example by displaying a moving light that oscillates in position in accordance with a preferred frequency of user movement for a selected exercise. As another example, the display console 126 may display preferred body positions for a selected exercise to guide a user through performance of an exercise. As another example, the display console 126 may including a camera and networking components configured to allow a remote instructor to view a user's interactions with the reformer 100 and provide real-time coaching to the user and/or make changes to exercise settings for the reformer 100 remotely (e.g., to remotely control the force generated by the actuator 106). The display console 126 can thereby enable complex and advantageous interactivity between the user and the reformer 100.

Figure 2:
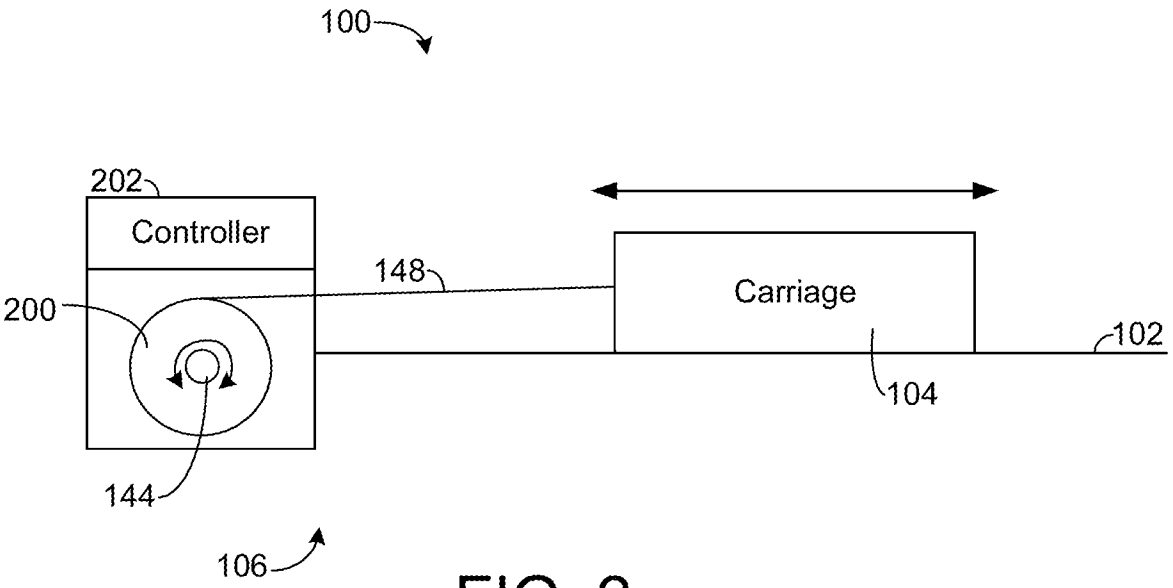
FIG. 2 is a schematic side view of the motorized reformer of FIG. 1, according to some embodiments.

Referring now to FIG. 2, a schematic side view of the reformer 100 is shown, according to some embodiments. As shown in FIG. 2, the force transfer member 148 is configured as a flexible cable (or cord, wire, rope, etc.) which extends from a spool 200 to the carriage 104. In such embodiments, the force transfer member 148 can wind around the spool 200, such that different amounts of cable (i.e., different lengths of the force transfer member 148) are played out between the spool 200 and the carriage 104 when the carriage 104 is a different positions relative to the base 102.

The spool 200 is coupled to or integral with the electric motor 144 such that the electric motor 144 can exert a torque on the spool 200. The torque creates tension in the force transfer member 148 which results in a force on the carriage 104 pointing toward the spool 200. The electric motor 144 may be operable to maintain at least a minimum tension in the force transfer member 148 to prevent slack in the force transfer member 148 (i.e., to prevent an excess of cable between the spool 200 and the carriage 104). As such, the rotational position of the spool 200 is indicative of the translational position of the carriage 104. The actuator 106 may include a sensor configured to obtain the rotational position of the spool 200, count rotations of the spool 200, etc. in order to obtain data indicative of the translational position of the carriage 104 along the longitudinal direction of the base 102.

FIG. 2 also shows that the reformer 100 can include a controller 202. The controller 202 is communicable with the actuator 106 (e.g., communicable with the electric motor 144). The controller 202 is configured to control the actuator 106, for example by controlling a voltage across the electric motor 144, power to the electric motor 144, current to the electric motor 144, etc. In some embodiments, the controller 202 is configured to determine a target force (e.g., force setpoint) for the actuator 106 and control the controller 202 to achieve the target force. For example, the controller 202 may use a function that maps force to voltage to identify a voltage for the electric motor 144 corresponding to the target force, and then provide the identified voltage across the electric motor 144. In other embodiments, a torque or force sensor is included with the motor 144 and/or the spool 200 and the controller 202 is configured as a feedback controller that drives a measured force or torque production to a setpoint. Various control modalities are executable by the controller 202 in various embodiments. The controller can include logic for performing closed-loop feedback control.

This can include adjusting the current or voltage to the motor based on difference between the target force or position and the actual force or position.

Figure 3:
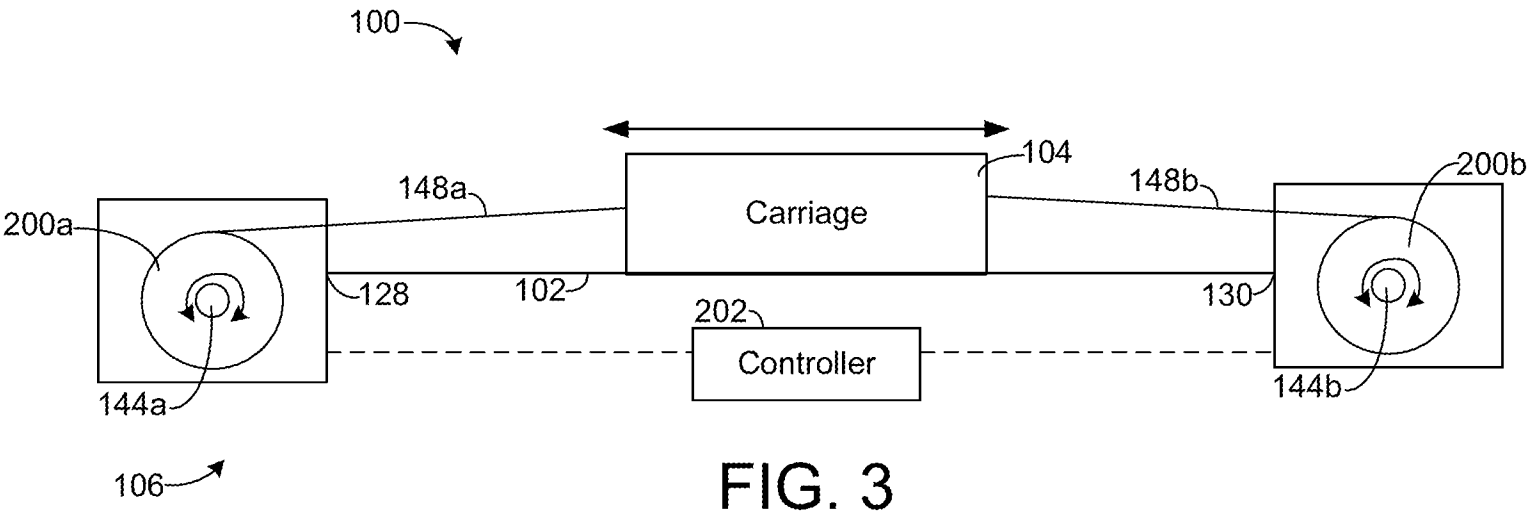
FIG. 3 a schematic side view of the motorized reformer of FIG. 1, according to some embodiments.

Referring now to FIG. 3, another schematic side view of the reformer 100 is shown, according to some embodiments. In the example of FIG. 3, the actuator 106 is configured to exert a force on the carriage 104 pointing toward the first end 128 of the base 102 and toward the second end 130 of the base 102 (e.g., at different times). As shown in FIG. 3, the actuator 106 includes two electric motors (shown as a first electric motor 146*a* and a second electric motor 146*b*), two spools (shown as a first spool 200*a* and a second spool 200*b*), and two force transfer members (shown as a first force transfer member 148*a* and a second force transfer member 148*b*). The first electric motor 146*a* acts on the first spool 200*a* and the first force transfer member 148*a* to provide a force on the carriage 104 pointing toward the first end 128 of the base 102, and the second electric motor 144*b* acts on the second spool 200*b* and the second force transfer member 148*b* to provide a force on the carriage 104 pointing toward the second end 130 of the base 102, according to the principles and interactions described above with reference to FIG. 2.

The controller 202 is configured to control the actuator 106 in a similar manner as described above with reference to FIG. 2 while coordinating operation of the first electric motor 144*a* and the second electric motor 144*b* to achieve a target total force on the carriage 104. For example, the controller 202 may determine whether a target force for the actuator 106 points towards the first end 128 or the second end 130 and use such a determination to select which actuator 106 to primarily control to achieve the target force. For example, the controller 202 can operate the first electric motor 144*a* (e.g., while controlling the second electric motor 144*n* to provide negligible force) to direct the force on the carriage 104 toward the first end 128, and can operate the second electric motor 144*b* (e.g., while controlling the first electric motor 144*a* to provide negligible force) to direct the force on the carriage 104 toward the second end 130. The controller 202 may determine a net force on the carriage resulting from the combined operation of the first electric motor 144*a* and the second electric motor 144*b* and control the net force to achieve a target force on the carriage 104. In other scenarios, the controller 202 may coordinate operation of the first electric motor 144*a* and the second electric motor 144*b* to drive the carriage 104 through a series of desired positions for the carriage 104 over time. In the example shown in FIG. 3, the reformer 100 is configured to provide forces on the carriage 104 in both directions, thereby enable forces on the carriage 104 not achievable with conventional reformers. Additional or improved exercises are thus enabled by the reformer 100.

Figure 4:
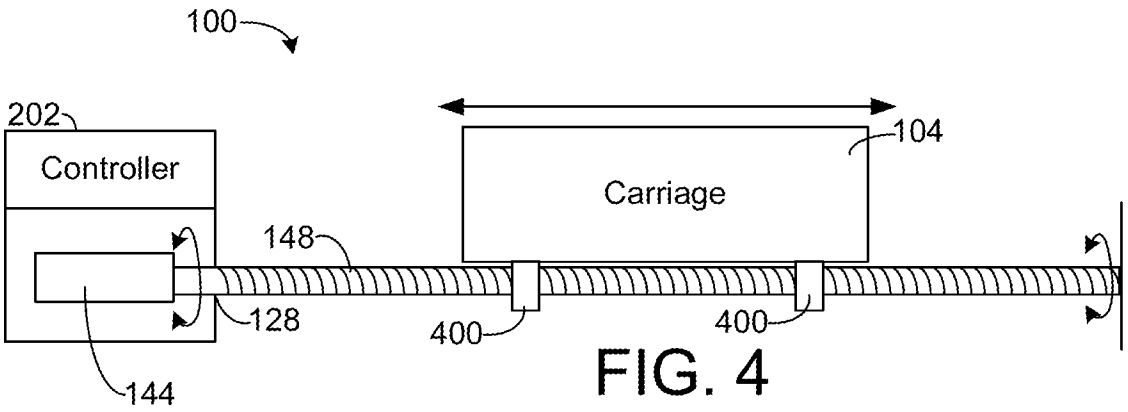
FIG. 4 is a schematic side view of the motorized reformer of FIG. 1, according to some embodiments.

Referring now to FIG. 4, another schematic side view of the reformer 100 is shown, according to some embodiments. In the example of FIG. 4, the force transfer member 148 is a threaded shaft extending from the electric motor 144 and along the longitudinal direction of the base 102, for example from the first end 128 of the base 102 to the second end 130 of the base 102. The carriage 104 includes one or more threaded loops 400 that interface with the carriage 104 and cause the carriage 104 to ride on the force transfer member 148. The threaded loops 400 are fixed relative to the carriage 104 and can move along the force transfer member 148 when the force transfer member 148 rotates relative to the threaded loops 400. The carriage 104 may prevented from rotating (e.g., by the base 102) such that rotation of the force transfer member 148 does not cause rotation of the carriage 104.

The electric motor 144 can operate to force rotation of the force transfer member 148 about an axis of the force transfer member 148. When the electric motor 144 drives rotation of the force transfer member 148 in a first direction (e.g., clockwise), the threading of the force transfer member 148 pulls the threading of the threaded loops 400 towards the first end 128 of the base 102. When the electric motor 144 drives rotation of the force transfer member 148 in a second direction (opposite the first direction, e.g., counterclockwise), the threading of the force transfer member 148 pushes the threading of the threaded loops 400 towards the second end 130 of the base 102. The electric motor 144 is thus operable to exert forces on the carriage 104 both towards and away from the first end 128 along the longitudinal direction and affect translation of the carriage 104 both towards and away from the first end 128 along the longitudinal axis of the base 102.

The controller 202 is operable to control the electric motor 144 to apply a target force to the carriage 104 and/or drive the carriage 104 to a target position. For example, as described above, the controller 202 may store or generate a mapping of motor voltage or current to resulting force on the carriage 104 and affect the voltage or current accordingly to achieve a target force. As another example, the actuator 106 can include a sensor (e.g., embedded in or with the electric motor 144) configured to count rotations of the force transfer member 148 and calculate a carriage position (or a change thereof) based on the counted rotations. The controller 202 may perform a calibration procedure to find endpoints of the carriage position from which to calculate real-time position based on rotation counting, for example by driving the carriage 104 to a limit of the range of motion of the carriage 104 (e.g., detected by a voltage/power spike without continued rotation) to automatically find a starting point for position calculations. Various other control modalities as described herein can be executed by the controller 202. As in the example of FIG. 3, the example of FIG. 4 enables the reformer 100 to provide dynamic forces on the carriage 104 which are not achievable with a conventional reformer, thereby providing improved and new exercises, enhanced workouts, etc.

Figure 5:
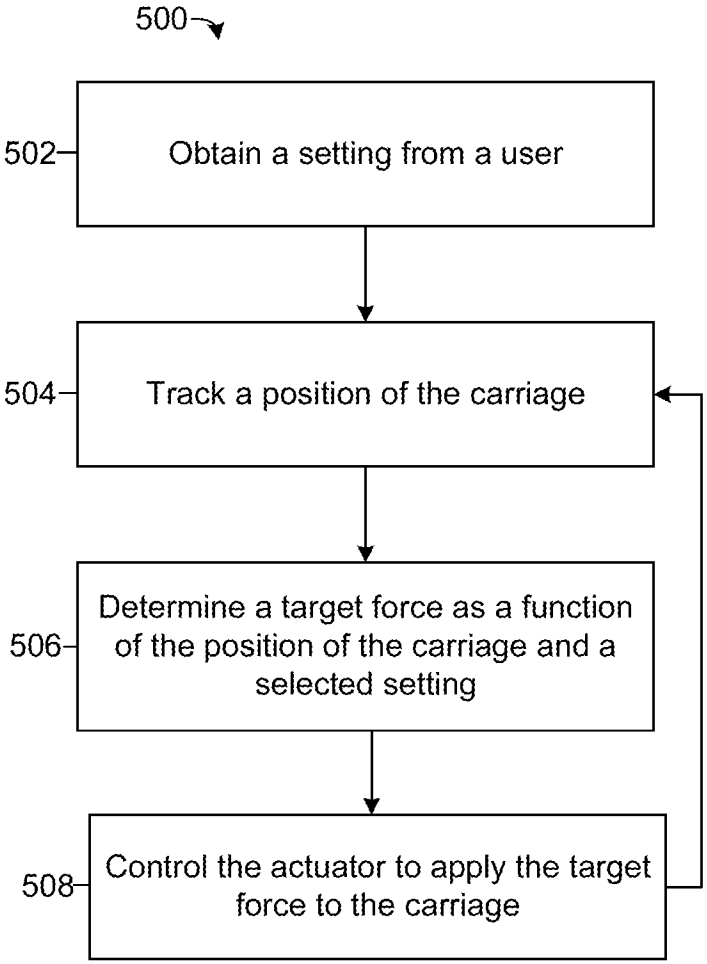
FIG. 5 is a flowchart of a first process of operating the motorized reformer of FIG. 1, according to some embodiments.

Referring now to FIG. 5, a flowchart of a process 500 for operating the reformer 100 is shown, according to some embodiments. The process 500 can be performed by the controller 202 of the reformer 100 in some embodiments.

At step 502, a setting obtained from a user. The setting may be obtained from the user via the display console 126 of FIG. 1. For example, the display console 126 may display a graphical user interface prompting the user to select a setting. As another example the setting may be input by a user via a control knob or other analog input device.

In the example of process 500, the setting obtained in 502 is indicative of a resistance or assistance level a user desires to be provided by the reformer 100, i.e., by the force on the carriage 104 generated by the actuator 106, for example indicative of a desired spring constant to be simulated by the actuator 106. For example, in some embodiments the setting is a user selection of a level along a generic scale (e.g., high, medium, low; integers 1-10; etc.). As another example, the setting may be provided in units or scaling based on the options available for conventional reformers (where color-coded mechanical springs are selected between). In such embodiments, the display console 126 may allow a user to digitally select which spring or springs that the user would like the actuator 106 to simulate to obtain the setting. The display console 126 may also allow the user to fine-tune such a setting by marginal increasing or decreasing a spring constant to allow more flexibility and customizability than conventional reformers. Various other examples are possible for obtaining a setting from a user relating to a desired operation of the actuator 106.

At step 504, a position of the carriage is tracked. For example, the position of the carriage may be tracked using sensors, encoders, etc. of the actuator 106 (e.g., measuring rotations of the electric motor 144). As another example, the position of the carriage may be tracked using an optical distance sensor (e.g., triangulation based laser sensor) either coupled to the carriage and arranged to measure a distance to a fixed reference point on the base (e.g., to the first end 128 or the second end 130) or coupled at a fixed reference point of the base and arranged to measure a distance to the carriage. The position of the carriage is thus obtained in substantially-real time (e.g., at a high enough frequency to be experience as real-time by a typical user) in step 504.

At step 506, a target force for the actuator 106 to apply to the carriage 104 is determined as a function of the position of the carriage 104 (from step 504) and the setting from the user (from step 502). In some embodiments, the setting is indicative of a constant (e.g., spring constant) and the function includes multiplying the constant by a distance between the position of the carriage and a fixed reference point on the base. For example, step 506 may include calculating a target force $F_{target}$ based on a function $F_{target}=k\,x$, wherein x is a distance between the position of the carriage 104 and a fixed reference point on the base 102 (e.g., the first end 128) and k is a constant scaling factor (spring constant) indicated by the setting obtained in step 504. In such examples, the target force increases with distance from the reference point according to the same functions that characterize forces generated by springs. In such embodiments, the target force for the actuator 106 is thereby determined such that the target force may simulate forces generated by springs of a conventional reformer.

In some embodiments, the function for calculating the target force includes different or additional terms or operations such that a variety of force trajectories which differ from those generated by conventional reformers may be determined. For example, a function of $F_{target}=k\,x^2$ may be provided to cause the force to increase faster as distance increases, or $F_{target}=k\,x^{0.5}$ to cause the force to increase slower as distance increases. As another example, the function may be non-monotonic as distance increases (e.g., $F_{target}=k*\sin(x)$). As another example, a user setting may indicate a factor other than a scaling factor (e.g., used as an exponent as in $F_{target}=x^k$). As another example, another variable may be included in the function, for example time t such that the target force is also a function of time (e.g., $F_{target}=k*x*\sin(t)$), number of exercise repetitions, etc. Various examples of continuous and discontinuous functions usable to calculate the target force as a function of distance and a user setting are possible.

At step 508, the actuator 106 is controlled to apply the target force to the carriage 508. For example, the controller 202 can provide a control signal to the electric motor 144, affect the voltage across the electric motor 144, etc. to cause the electric motor 144 to operate to generate a force on the carriage 104 that matches the target force. In some embodiments, a sensor may be included in the actuator 106 that measures the force generated by the electric motor 144, such that step 508 can include providing feedback control (e.g., a proportionally-integral-derivative controller) that controls the electric motor 144 to drive the measured force toward the target force. The target force calculated at step 506 can thus be provided on the carriage 104 at step 508.

Steps 504, 506, and 508 can be executed repeatedly such that the force on the carriage 104 by the actuator 106 updates with changes in position. For example, steps 504, 506, 508 of process 500 can be executed at a high frequency (e.g., 10, 20, 30, 40, 50, etc. times per second) such that a user experiences the force on the carriage 104 as updating in real-time with changes in position of the carriage 104. Smooth, user-friendly force production is thereby provided on the carriage 104 to assist and/or resist performance of exercises such as Pilates exercises.

Figure 6:
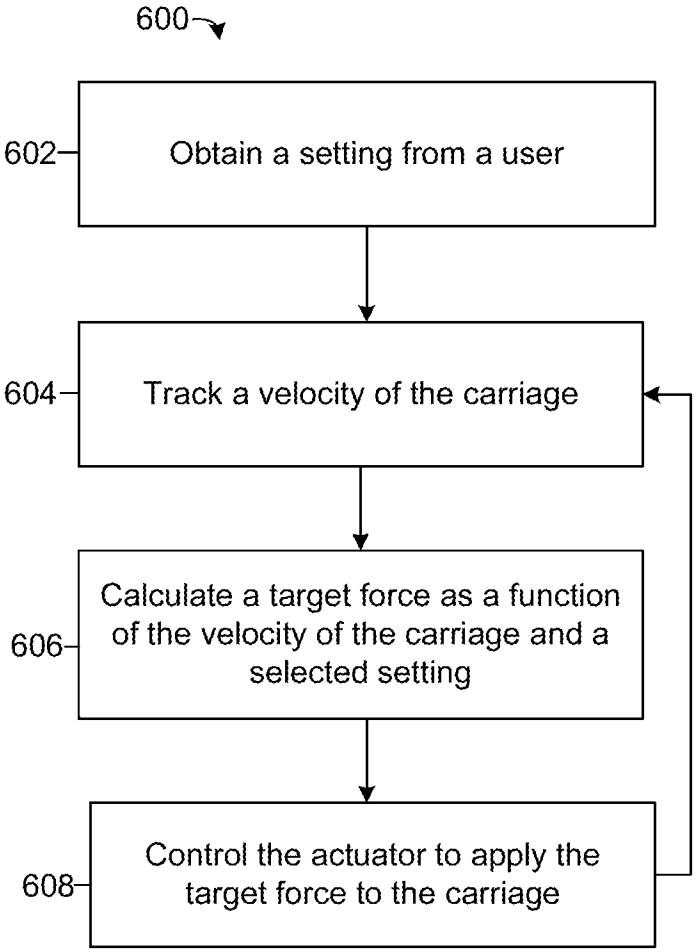
FIG. 6 is a flowchart of a second process of operating the motorized reformer of FIG. 1, according to some embodiments.

Referring now to FIG. 6, a flowchart of another process (process 600) of operating the reformer 100 is shown, according to some embodiments. The process 600 can be performed by the controller 202 of the reformer 100 in some embodiments.

At step 602, a setting is obtained from a user. Step 602 may be similar to step 502 described above. For example, step 602 can include a user indicating a difficulty level, resistance level, scaling factor, etc. via a user interface of the reformer 100, e.g., a graphical user interface on the display console 126.

At step 604, a velocity of the carriage 104 is tracked. The velocity of the carriage 104 can be tracked by tracking a position of the carriage 104 as in step 504 described above and taking a time derivative of the position (velocity $v=dx/dt$) or otherwise using a change in position of the carriage 104 to calculate velocity. In some scenarios, the velocity is obtained directly from a sensor included with the actuator 106. The velocity of the carriage 104 can be determined in substantially real-time, i.e., at a high enough frequency so as to be perceived as real-time to a typical user. Step 604 can include determining both a magnitude and direction of the velocity, just a direction of the velocity, or just a magnitude of the velocity in various scenarios.

At step 606, a target force to be applied to the carriage 104 by the actuator 106 is determined as a function of the user-selected setting (from step 602) and the velocity of the carriage 104 (from step 604). For example, the setting may be indicative of a scaling factor k and the function can include multiplying the scaling factor by the velocity (e.g., $\vec{F}_{target}=-k\vec{v}$). The force can point the opposite direction of the velocity (e.g., $\vec{F}_{target}=k\,\vec{v}$), or the same direction as the velocity, e.g., ($\vec{F}_{target}=k\vec{v}$). In some embodiments, the function is designed to dampen the magnitude of the velocity, for example by calculating the force base on a deviation from a target velocity indicated by the user-selected setting ($\vec{F}_{target}=(\vec{v}_{userselected}-\vec{v})$ for $|\vec{v}|\geq|\vec{v}_{userselected}|$). Such embodiments may be advantageous where an exercise is intended to be performed at a controlled, steady pace or speed. Various such functions are possible at step 606 and can be user-selectable in various embodiments.

At step 608, the actuator 106 is controlled to provide the target force on the carriage 104. For example, the controller 202 can operate as described with reference to step 508 to cause the carriage 104 to experience the target force.

Steps 604, 606, and 608 can be executed repeatedly with changes in velocity of the carriage. For example, steps 604, 606, 608 of process 600 can be executed at a high frequency (e.g., 10, 20, 30, 40, 50, etc. times per second) such that a user experiences the force on the carriage 104 as updating in real-time with changes in velocity of the carriage 104. Smooth, user-friendly force production is thereby provided on the carriage 104 to assist and/or resist performance of exercises such as Pilates exercises.

It should be noted that the target force based on position as shown in FIG. 5 and the target force based on velocity as shown in FIG. 6 are not mutually exclusive. There are operational modes in which the desired force can be a function of position and velocity.

Figure 7:
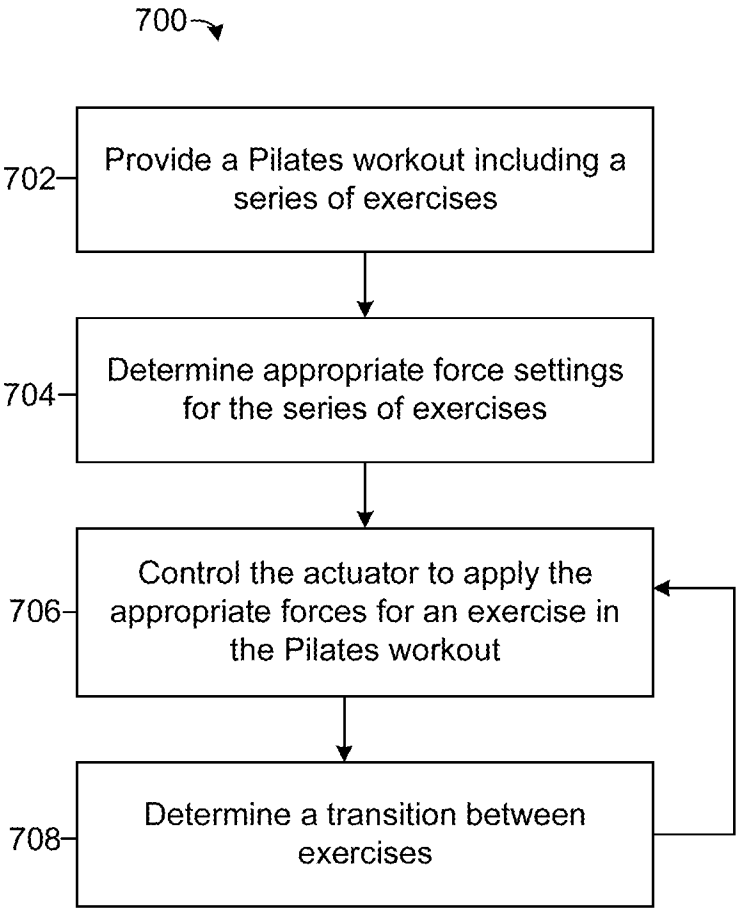
FIG. 7 is a flowchart of a third process of operating the motorized reformer of FIG. 1, according to some embodiments.

Referring now to FIG. 7, a flowchart of yet another process (process 700) of operating the reformer 100 is shown, according to some embodiments. The process 700 can be performed by the controller 202 in some embodiments. In some embodiments, the controller 202 is communicable with a server, cloud-based computing resource, external computing device, etc. that contributes to execution of process 700.

At step 702, a Pilates workout including a series of exercises is provided. The Pilates workout can include multiple different exercises arranged in a particular order. The Pilates workout can also indicate a duration, number of repetitions, etc. for each of the exercises. The Pilates workout can be stored as a data file on the controller 202, on a memory device of the display console 126, or on a remote server, cloud-based computing resource, external memory device, etc. communicable with the controller 202 over a network (e.g., over the Internet) in various embodiments. In some scenarios, the Pilates workout is predesigned (e.g., by a professional Pilates instructor) and available to users of multiple reformers 100. In other scenarios, the Pilates workout is customized for a user (e.g., by a private instructor, by the user) and made available to a particular user or on a particular reformer 100. In some embodiments, the display console 126 is configured to display a graphical user interface that allows a user to select the Pilates workout from a set of available Pilates workouts and/or to build a Pilates workout by selecting multiple exercises.

At step 704, appropriate force settings for the series of exercise are determined. For example, the multiple exercise of the series of exercises may be associated with multiple settings and different functions, for example different selections of the multiple examples described above with reference to process 500 and process 600. For example, the force settings for a first exercise may include a first function (e.g., $F_{target}$=k x) and a first value of a scaling factor (e.g., k=3), while the force settings for a second exercise may include a second function (e.g., $F_{target=k\ x^2}$) and/or a second value of a scaling factor (e.g., k=5). The logic for dynamically calculating the target force can thus be defined separately for each exercise of multiple sequential exercises in a Pilates workout.

Still referring to step 704, the appropriate force settings can be determined based on various inputs. In some examples, each type of exercise may have a preset function associated therewith, for example selected by Pilates experts and stored in a library/database accessible during step 704. In such embodiments, each function can be customized for a particular user based on a user-specific setting (e.g., scaling factor, spring constant, etc.). The user-specific setting may be user-selected for each exercise. In some embodiments, the user-specific settings for the exercises are different for each exercise in the workout but may be calculated based on a single user selection of a difficulty level (e.g., easy, medium, hard, etc.; integer on a 1-10 scale) according to a pre-defined table or mapping for each exercise. In yet other embodiments, a private Pilates instructor or coach can input settings for each exercise for the particular user, for example remotely via a web-based interface or mobile application communicable with the reformer 100 via a network (e.g., over the Internet). Various ways of determining appropriate force settings for each exercise in a selected workout are possible at step 704.

At step 706, the actuator 106 is controlled to apply the appropriate forces for an exercise in the Pilates workout. The Pilates workout may start with a first exercise, which is associated with a particular logic (e.g., function and setting) for determining the force to provide on the carriage 104. Step 706 can include executing steps 504, 506, 508 of process 500 or steps 604, 606, 608 of process 600 to determine a target force in accordance with that logic and control the actuator 106 to provide the target force on the carriage 104. Step 706 can also include executed step 804 of FIG. 8, described below, in some scenarios. The logic for the first exercise can be executed (e.g., by the controller 202) for a duration of the first exercise.

At step 708, a transition between exercises is determined. To continue the example above, step 708 includes determining that the first exercise is complete and that a second exercise should be initiated. Completion of the first exercise may be determined in multiple ways, for example based on information stored as part of the selected Pilates workout. As one example, the first exercise may be scheduled to last for a preset duration and step 708 includes determining that the present duration has elapsed. As another example, the Pilates workout may indicate that the first exercise is to be performed a preset number of times and step 708 includes counting repetitions (e.g., based on positions of the carriage 104 over time) until the preset number of repetitions occur (which indicates completion of the first exercise). As another example, step 708 may include determining that the user moved the carriage 104 from a first position associated with performance of the first exercise (e.g., spaced apart from the first end 128 of the base) to a second position associated with completion of the first exercise (e.g., proximate the first end 128 of the base), such that a user can indicate completion of the first exercise by moving the carriage 104 to a transition position. In other embodiment, the user may provide an input (e.g., voice command, button press, etc.) to indicate completion of the first exercise.

Following determination of the transition between exercises at step 708, the Pilates workout is advanced to the next exercise in the series of exercises and process 700 returns to step 706. In this subsequent instance of step 706, the force settings/logic for the subsequent exercise in the Pilates workout is executed to control the actuator to apply appropriate forces for that exercise. To continue the example from above, following determination of completion of a first exercise at step 708, the Pilates workout advances to a second workout at step 706 is executed based on force settings for the second workout. For example, the second execution of step 706 can include determining a target force using a different function of carriage position or velocity and/or a different scaling factor or other setting as compared to the first execution of step 706. Forces suitable for the second exercise are thereby exerted on the carriage 104 by the actuator 106.

Steps 706 and 708 can be repeated for a number of times corresponding to the number of exercises in the Pilates workout. Process 700 thereby provides suitable forces on the carriage 104 for a series of exercises without the user needing to adjust springs between exercise (as needed in conventional reformers) or otherwise adjust settings of the reformer between exercises. The reformer 100 thereby provides a user-friendly, self-advancing Pilates workout in which appropriate dynamic forces are provided on the carriage 104 for a series of exercises without requiring user intervention between exercises.

In some embodiments, process 700 also includes displaying instructions relating to performance of the Pilates workout, for example via the display console 126. For example, a live or recorded video of an instructor demonstrating the exercises can be shown on a screen of the display console 126 while audio instructions (e.g., the instructor's voice) is emitted from a speaker of the display console 126 (or via a user's headphones, etc.). As another example, animations or illustrations showing a user how to properly perform an exercise may be shown. Various such examples for guiding a user through a series of exercises may be provided. By executing process 700, the reformer 100 can thus provide a user with an immersive, seamless, guided Pilates experiences.

Figure 8:
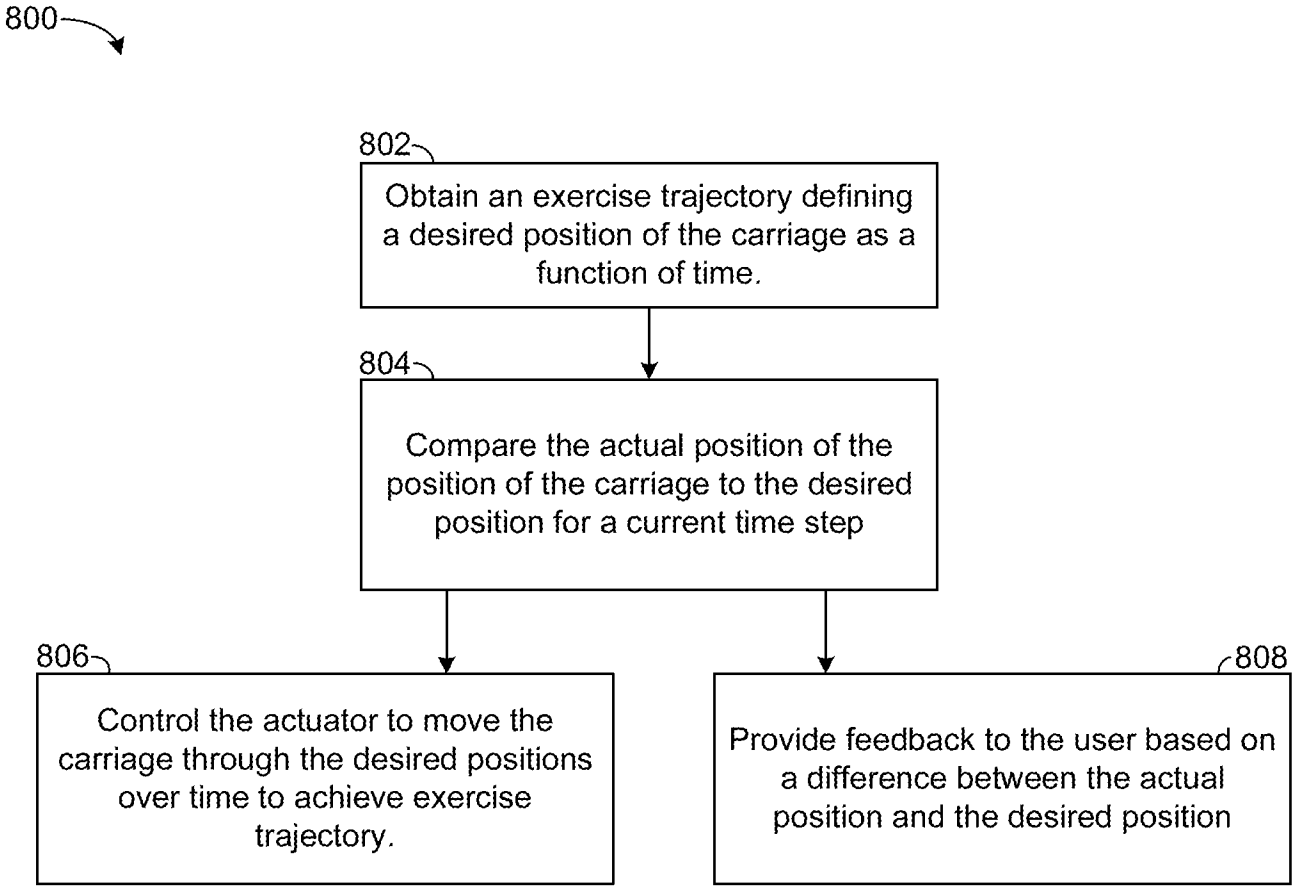
FIG. 8 is a flowchart of a fourth process of operating the motorized reformer of FIG. 1, according to some embodiments.

Referring now to FIG. 8, a flowchart of yet another process (process 800) of operating the reformer 100 is shown, according to some embodiments. The process 800 can be executed by the controller 202 in various embodiments.

For some Pilates exercises, desired performance (e.g., proper form, good practice, etc.) of the exercises involves moving the carriage 104 at a particular pace and/or through a particular range of motion or series of positions. Accordingly, it may be desirable for the reformer 100 to move the carriage 104 through the desired positions and at the desired pace for proper performance of the exercise or otherwise provide feedback relating to the desired positions. Such operation of the reformer 100 may be helpful for teaching novice users and for helping experienced users perfect techniques, among other possible advantages.

At step 802, an exercise trajectory defining a desired position of the carriage 104 as a function of time is obtained. The exercise trajectory may be stored in memory of the controller 202. The exercise trajectory may be predefined (e.g., at production of the reformer 100), for example programmed based on input from a professional Pilates instructor. The exercise trajectory thus defines desired positions of the carriage 104 which promote good technique and proper performance of an associated exercise by the user.

At step 804, the actual (current) position of the carriage 104 is compared to the desired position for a current time step as defined in the exercise trajectory. The actual position of the carriage 104 can be obtained as described above, e.g., using a sensor included with the actuator 106. Step 804 can include determining a magnitude and direction of a deviation of the actual position from the desired position for the current time.

In some embodiments or scenarios, the process 800 proceeds to step 806 where the actuator 106 is controlled to move the carriage 104 through the desired positions over time to achieve the exercise trajectory. In such embodiments, the controller 202 may be operated as a feedback controller that receives a result of step 804 (e.g., an indication of a direction and magnitude of a deviation of the actual position from the desired position for the current time from the exercise trajectory and the actual/current position of the carriage 104) and uses that information as an input for controlling the carriage 104 towards the desired position for the current time. For example, a higher force may be provided at larger deviations (e.g., ($\vec{F}_{target}=k(\vec{x}_{desired}-\vec{x}_{actual})$)), for example such that the actuator 106 acts as a spring driving the carriage 104 toward the desired position. In some examples, operation of the actuator 106 as in step 804 resists movements of the user which may be faster than a desired pacing while assisting the user's movements when the user is moving slower than a desired pacing. The reformer 100 thereby operates to provide force feedback on the carriage 104 that guides the user through the exercise trajectory.

In some embodiments or scenarios, process 800 proceeds to step 808 from step 804. In step 808, feedback is provided to the user based on the difference between the actual position and the desired position (i.e., based on a result of the comparison of step 804). The feedback may be audible, visual, and/or haptic in various embodiments. In some examples, step 808 includes operating a speaker of the reformer 100 to emit a sound (e.g., beep, buzz, alarm, voice instructions, etc.) indicating to the user that the carriage 104 has deviated from the desired position and, in some cases, providing instructions on how to move to achieve the desired position (e.g., "Move Up," "Move Down" emitted by a speaker of the reformer 100). In some examples, step 808 includes displaying, on a screen of the display console 126, the user's position relative to the desired position for the current time. In further examples, providing the feedback at step 808 can include controlling the actuator 106 to provide a haptic indication to the user via the carriage 104. Such haptic feedback may be designed to signal deviation to the user without actively correcting the deviation such that the user is subjected to a potentially higher level of difficulty as compared to in scenarios where step 806 is executed. The haptic feedback in step 808 may include discontinuous tugs or vibrations provided to the carriage 104 by the actuator 106. Execution of step 808 can thus result in communication to a user that causes the user to understand that the user deviated from the desired trajectory and should change the user's performance of the exercise to correct the deviation. A user can thus be encouraged to achieve proper technique by the reformer 100.

The systems and methods described herein thereby provide for user-friendly, customizable, dynamic workout experiences using the reformer 100. The reformer 100 is suitable for exercises commonly referred to as Pilates exercises, and may also enable new types of exercises and support exercises from other disciplines (yoga, etc.). The reformer 100 can be adapted to provide any such exercises and workouts including any such workouts.

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

The hardware and data processing components (e.g., controllers) used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

What is claimed is:

1. A reformer, comprising:

a base having a longitudinal direction;

a carriage coupled to the base and moveable relative to the base in the longitudinal direction;

an actuator coupled to the carriage and the base such that the actuator is arranged to exert a force between the carriage and the base, wherein the force moves the carriage relative to the base in the longitudinal direction or resists movement of the carriage relative to the base in the longitudinal direction; and a controller communicable with the actuator, wherein the controller is configured to:

determine a desired position of the carriage relative to the base based on an exercise trajectory; and control the actuator to vary the force based on a comparison of an actual position of the carriage relative to the base and the desired position of the carriage relative to the base.

2. The reformer of claim 1, wherein the controller is configured to control the actuator by adjusting current or voltage to the actuator based on a difference between a target value for the force and an actual value of the force.

3. The reformer of claim 1, wherein the controller is configured to multiply a distance between the actual position of the carriage and a fixed reference point by a constant such that the force simulates a spring force.

4. The reformer of claim 3, further comprising a user interface, wherein the constant is user-selectable via the user interface.

5. The reformer of claim 1, wherein the controller is configured to control the actuator to provide a haptic indication to a user via the carriage to indicate a deviation between the actual position of the carriage and the desired position of the carriage.

6. The reformer of claim 5, wherein the haptic indication comprises a tug on the carriage.

7. The reformer of claim 1, wherein the controller is configured to control the actuator to move the carriage to the desired position to cause a user to perform an exercise associated with the exercise trajectory.

8. The reformer of claim 1, wherein the actuator comprises a spool, an electric motor coupled to the spool, and a cable extending from the spool to the carriage and arranged to wind around the spool;

wherein the electric motor is operable to exert a torque on the spool to wind the cable around the spool and resist unwinding of the cable from the spool such that the force on the carriage results from the torque on the spool by the electric motor.

9. The reformer of claim 1, wherein the actuator comprises a linear electrical actuator.

10. The reformer of claim 1, wherein the actuator comprises a threaded shaft and an electric motor coupled to the threaded shaft and operable to rotate the threaded shaft;

wherein the carriage is mounted on the threaded shaft such that rotation of the threaded shaft causes translation of the carriage along the longitudinal direction of the base.

11. The reformer of claim 1, wherein the carriage comprises a padded platform, a shoulder rest, and a headrest.

12. The reformer of claim 1, further comprising a post extending from the base, a pulley mounted on the base, a cable coupled to the carriage, and a handle, wherein the cable extends from the carriage and around the pulley to the handle.

13. The reformer of claim 12, wherein the actuator is configured to pull the carriage toward a first end of the base along the longitudinal direction, and wherein pulling on the handle pulls the carriage toward a second end of the base opposite the first end along the longitudinal direction.

14. The reformer of claim 1, further comprising a footrest mounted on the base.

15. The reformer of claim 1, wherein the controller is configured to perform the comparison of the actual position of the carriage to the desired position for a selected exercise and cause feedback to be provided to a user of the reformer based on the comparison.

16. A method of providing a Pilates exercise, comprising:

obtaining a desired position of a carriage of a reformer based on an exercise trajectory;

determining an actual position of the carriage relative to a base of the reformer;

performing a comparison of the actual position of the carriage to the desired position of the carriage;

calculating a target force based on the comparison; and exerting the target force on the carriage by operating an actuator coupled to the carriage in accordance with the target force.

17. The method of claim 16, wherein exerting the target force comprises providing a haptic indication to a user via the carriage to indicate a deviation between the actual position of the carriage and the desired position of the carriage obtained based on the exercise trajectory.

18. The method of claim 17, wherein calculating the target force comprises determining a distance between the actual position of the carriage and a fixed reference point and multiplying the distance by a spring constant.

19. The method of claim 16, wherein exerting the target force comprises moving the carriage to the desired position to achieve user performance of an exercise associated with obtaining the exercise trajectory.

20. The method of claim 16, wherein obtaining the exercise trajectory comprises determining the exercise trajectory based on a Pilates workout regimen.

* * * * *